US008163371B2

(12) United States Patent
Nevison

(10) Patent No.: US 8,163,371 B2
(45) **Date of Patent: *Apr. 24, 2012**

(54) MAT

(76) Inventor: Dale C. H. Nevison, Algonac, MI (US)

( * ) Notice: Subject to any disclaimer, the term of this patent is extended or adjusted under 35 U.S.C. 154(b) by 979 days.

This patent is subject to a terminal disclaimer.

(21) Appl. No.: 11/742,103

(22) Filed: Apr. 30, 2007

(65) Prior Publication Data

US 2007/0212523 A1 Sep. 13, 2007

Related U.S. Application Data

(63) Continuation of application No. 10/811,590, filed on Mar. 29, 2004, now Pat. No. 7,211,314.

(51) Int. Cl.
*B32B 3/10* (2006.01)
*A47G 9/06* (2006.01)

(52) U.S. Cl. ..... 428/131; 428/167; 5/417

(58) Field of Classification Search ..... 428/131, 428/141, 143, 156, 168, 167; 15/215; 404/34, 404/35, 42; 5/420
See application file for complete search history.

(56) References Cited

U.S. PATENT DOCUMENTS 212,497 A 2/1879 Perry
1,619,773 A 3/1927 Van Der Pyl
2,670,060 A 2/1954 Fenske
2,810,672 A 10/1957 Taylor
3,251,076 A * 5/1966 Burke ..... 428/116
4,336,293 A * 6/1982 Eiden ..... 428/143
4,436,779 A * 3/1984 Menconi et al. ..... 428/169
4,478,901 A 10/1984 Dickens et al.
4,727,697 A 3/1988 Vaux
4,964,514 A 10/1990 Wycech
4,991,834 A 2/1991 Vaux
5,385,770 A * 1/1995 Julnes ..... 428/195.1
5,447,387 A 9/1995 Fagan
5,456,966 A 10/1995 Austin
5,527,128 A 6/1996 Rope et al.
5,833,386 A 11/1998 Rosan et al.
7,211,314 B2 * 5/2007 Nevison ..... 428/143
2003/0141621 A1 7/2003 Shannon

* cited by examiner

*Primary Examiner* — Donald J Loney
(74) *Attorney, Agent, or Firm* — Gregory T. Zalecki

(57) ABSTRACT

An improved mat is disclosed. Long and short legs support the mat and cause it to feel resilient although it is fabricated from hard rubber. The mat has drain holes on vertical surfaces. Ribs prevent the mat from embedding within grating. Grit is selectively placed upon the mat and physically supported. Adhesive for bonding the grit is retained by retention lips. Also disclosed is a process for creating drain holes on vertical surfaces of mats by attaching a grooving tool to a robot and programming the robot to cut through molded mat channels to create the desired drain holes. An additional process uses the robot to selectively place adhesive upon the mat. An adhesive dispenser is attached to the robot and the robot is appropriately programmed.

2 Claims, 6 Drawing Sheets

MAT

This application is a continuation of U.S. patent application Ser. No. 10/811,590 filed on Mar. 29, 2004, now pending.

BACKGROUND

Mats have many residential, commercial and industrial uses. Some of the most demanding uses involve factory applications. Mats are commonly placed around industrial machines. There they are subject to heavy traffic, as well as liquid, solid and chemical contamination.

Most industrial mats are fabricated from rubber. The rubber must be hard for durability. On the other hand, it should be resilient and compressive for the comfort and health of the user. These two properties are significantly incompatible with each other. A hard mat is not resilient and compressive. A soft mat, while resilient and compressive, is not durable.

Most mats are supported by legs. Mats are often placed upon metal gratings surrounding a machine or a work area. The gratings are necessary to receive and contain liquid and solid waste and contaminants. The use of mats with legs on top of metal gratings is problematic because the legs tend to sink into and embed within the gratings.

Many mats are fabricated to have surface drain holes to promote liquid and solid drainage. The holes are typically contained within the horizontal top surface of the mat. The problem with such a drain hole configuration is that the holes easily clog. They readily catch and retain foreign objects. A hard object trapped in an upright position within a drain hole often presents a serious safety hazard. The problem could be alleviated by positioning drain holes within a vertical wall on the top mat surface. Unfortunately, vertical wall drain holes are difficult to cost effectively mold into rubber.

Another problem with mats is that they are often subject to liquid, oily or slippery environments. Such environments constitute serious safety hazards because of the unsafe footing to which users are subjected. This problem can be alleviated by bonding grit to the top surface of a mat. However, it is often not cost-effective to cover a mat with grit. Further, the compressive forces to which a mat is subjected by users causes flexure of the mat which tends to break the bond holding the grit to the mat. As a result, it is difficult to keep sufficient grit bonded to a mat during the life expectancy of the mat.

The manufacturing cost of a grit covered mat could be reduced by only applying grit to selective areas of the mat. This becomes problematic because the adhesives typically used to bond grit to a mat are liquid or semiliquid. The adhesives tend to flow out of any surface area or channel to which they are applied. Further, there are no known methods to easily apply adhesives and grit to selective areas of mats.

There is a need for an improved mat which would have one or more of the following features. It could be manufactured from hard rubber for durability, yet feel compressive and resilient when stepped upon. When placed upon a grating it would not sink into or embed within the grating. It would have drain openings which are positioned within vertical surfaces on top of the mat. It would have areas of selectively placed grit bonded onto its top surface. A substantial portion of the selectively placed grit would be below the mat surface. The selectively placed grit would also have support from underneath to inhibit flexure causing the grit to become unbonded. Additionally, a cost-effective method for applying selectively placed grit to the top of the mat is needed. The tendency of a liquid adhesive to flow away from the area where it is initially placed needs to be minimized.

Because of the difficulty of cost effectively molding drain holes into vertical wall surfaces on top of a mat, there is also a need for a cost-effective process for creating drain holes within a vertical wall surface on top of a mat.

SUMMARY

The present invention provides a solution for these problems. One version of the invention is comprised of a mat base, a plurality of long legs, a plurality of short legs, a plurality of ribs, a plurality of channels, a plurality of grit trenches and grit. The mat base has a top surface and a bottom surface. The long legs are perpendicularly attached to the bottom surface of the mat base. This provides resilient support for the mat base.

The short legs are also perpendicularly attached to the bottom surface of the mat base. The short legs support the mat base and modify the resiliency of the mat. The long legs and the short legs are adapted to provide a selected mat compression when a load is applied to the top surface of the mat.

Each rib connects a pair of legs. The length of each rib, as measured along the dimension perpendicular to the mat when the rib is attached to the legs, is approximately the length of the legs to which it is attached. However, its length is not longer than either of the legs to which it is attached. When the mat is placed on top of a floor grating the rib between the legs tends to prevent the mat from becoming embedded within the grating.

The channels subdivide the mat top surface into mat segments. Each channel has a floor and a lateral wall surface. The lateral wall surface is vertically oriented with respect to the top surface of the mat. The lateral wall surface has a drain opening. The drain opening permits drainage from the top surface of the mat to below the bottom surface of the mat.

The grit trenches are embedded within the top surface of the mat. Each trench has two ends. Each end has a retention lip. The retention lip forms a dam for retaining adhesive and grit. The grit is bonded into the trenches by an adhesive. In order to reduce flexure within the trenches at least one trench is supported by some of the long legs perpendicularly attached to the bottom surface of the mat.

The preferred improved mat is constructed with all of the described features. An improved mat may also be constructed with less than all of the described features.

The invention includes a process for fabricating lateral drain openings into the top surface of a mat. The first step of the process is to mold a mat. The mat has a top surface and a bottom surface. Channels subdivide the mat top surface into mat segments. The channels have a floor and a lateral wall surface. The mat is also constructed to have a rib perpendicularly molded into the bottom surface of the mat below each channel.

The next step of the process is to remove material from the floor of at least one channel, at least one of its lateral wall surfaces and its underlying rib. The material is removed to a depth which is below the bottom surface of the mat base. The removal of the material will cause the formation of a drain opening within the lateral wall of the channel. The material can be removed with a grooving tool such as a tire groover.

Preferably, a programmable Cartesian robot is used to remove the material. A grooving tool, such as a tire groover is attached to the programmable Cartesian robot. The grooving tool has a heated blade. The programmable Cartesian robot is programmed to remove the material from the floor of each channel and its underlying rib. The mat is secured onto the workbed of the programmable Cartesian robot. The programmable Cartesian robot and the attached grooving tool are then used to remove the material from the floor of at least one channel, at least one of its lateral wall surfaces and its underlying rib.

Preferably, a programmable cartesian robot is also used to bond grit into the trenches embedded within the top surface of the mat. An adhesive dispenser is attached to the programmable Cartesian robot. The robot is programmed to fill the trenches with adhesive. The mat is secured onto the workbed of the robot. The robot then fills the trenches with adhesive. After the adhesive is placed, grit is spread over the top surface of the mat. Finally, the excess, non bonded, grit is removed. This may be done by shaking the grit off of the mat.

DRAWINGS

These and other features, aspects, and advantages of the present invention will become better understood with regard to the following description, appended claims, and accompanying drawings where:

Figure 2:
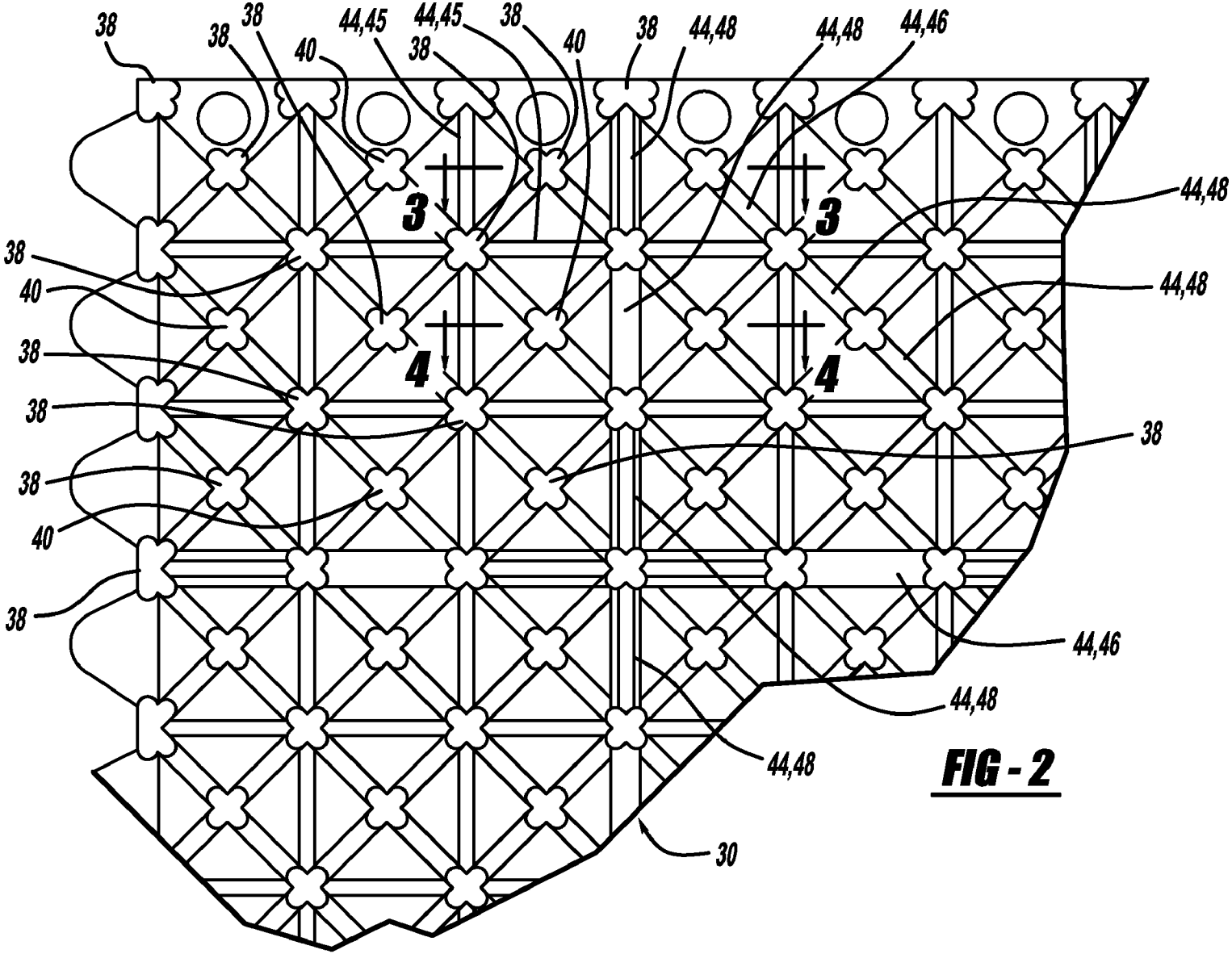
FIG. 2 is a bottom plan view of an improved mat.
Figure 4:
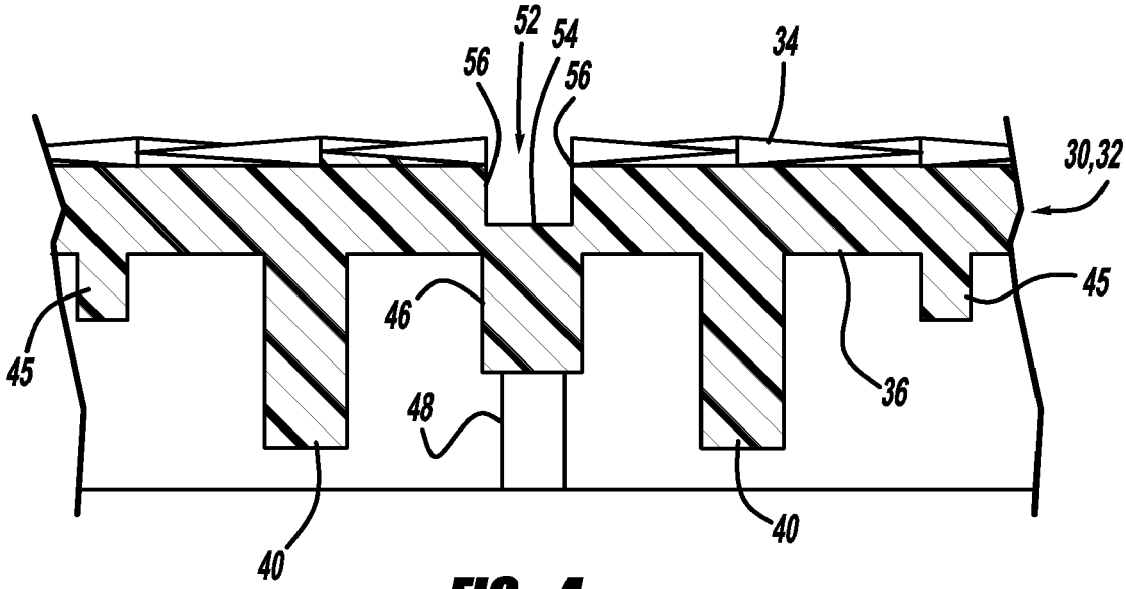
FIG. 4 is a another side elevation sectional view of a section of the improved mat of FIG. 2.
Figure 5A:
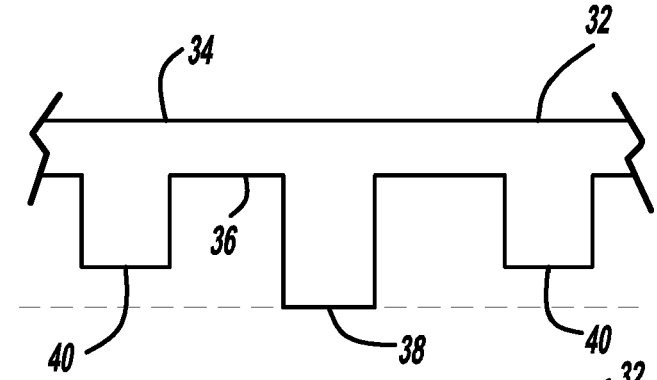
Figure 5B:
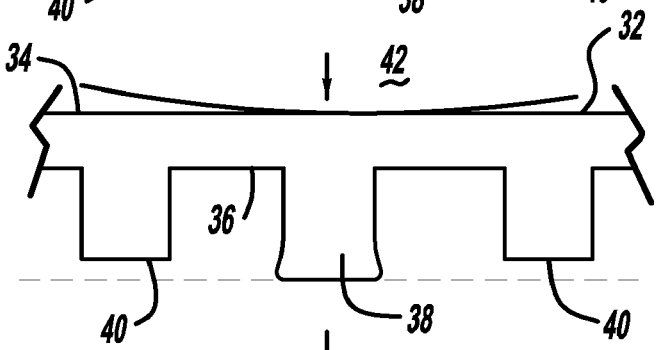
Figure 5C:
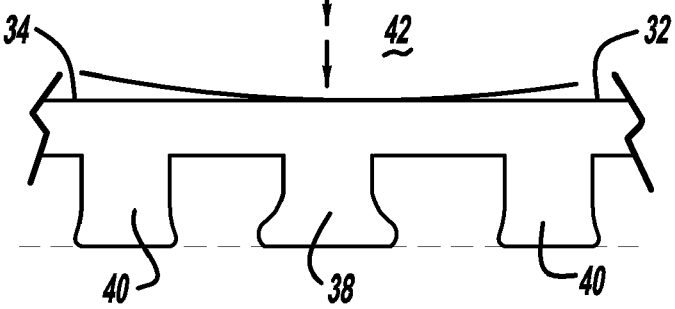

FIGS. 5*a*, 5*b* and 5*c* are side elevation sectional views of a section of the improved mat of FIG. 2 showing the compression of short legs and long legs of the mat when a compressive load is applied to the top surface of the mat.

Figure 1:
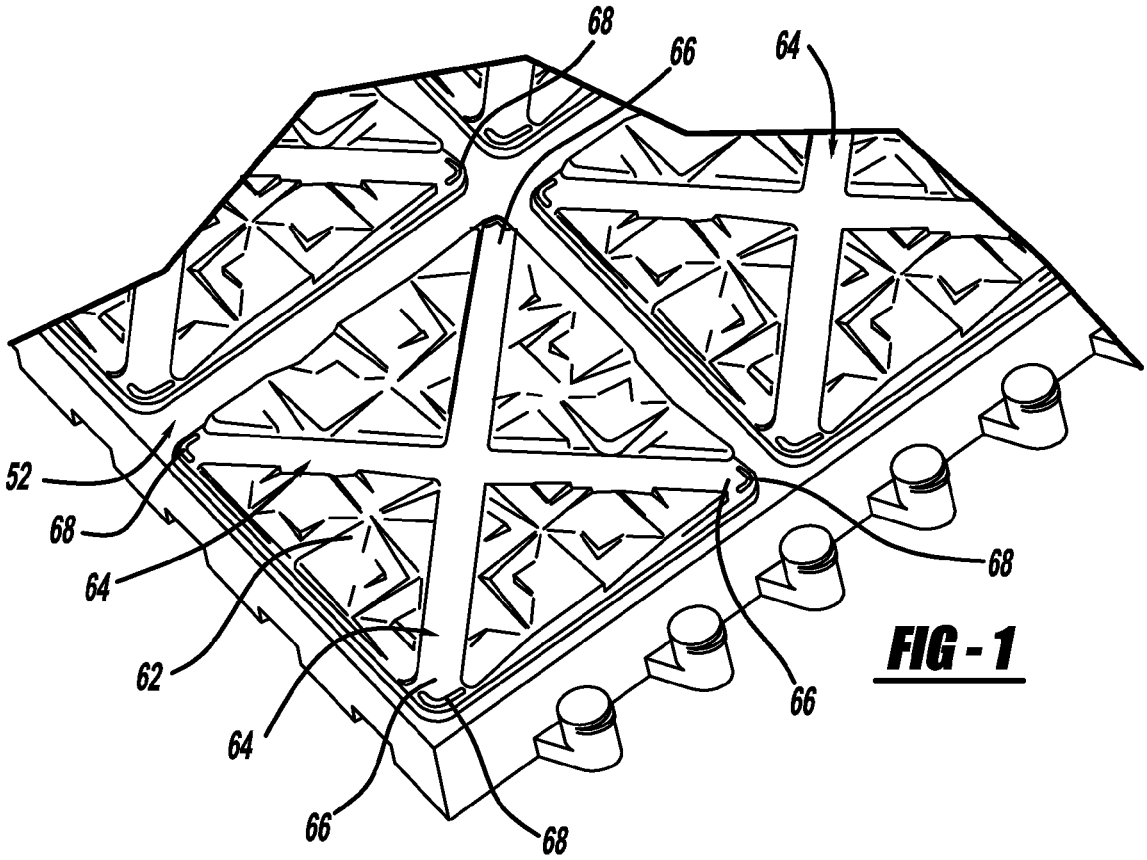
FIG. 1 is a perspective view of a mat segment of an improved mat.
Figure 3:
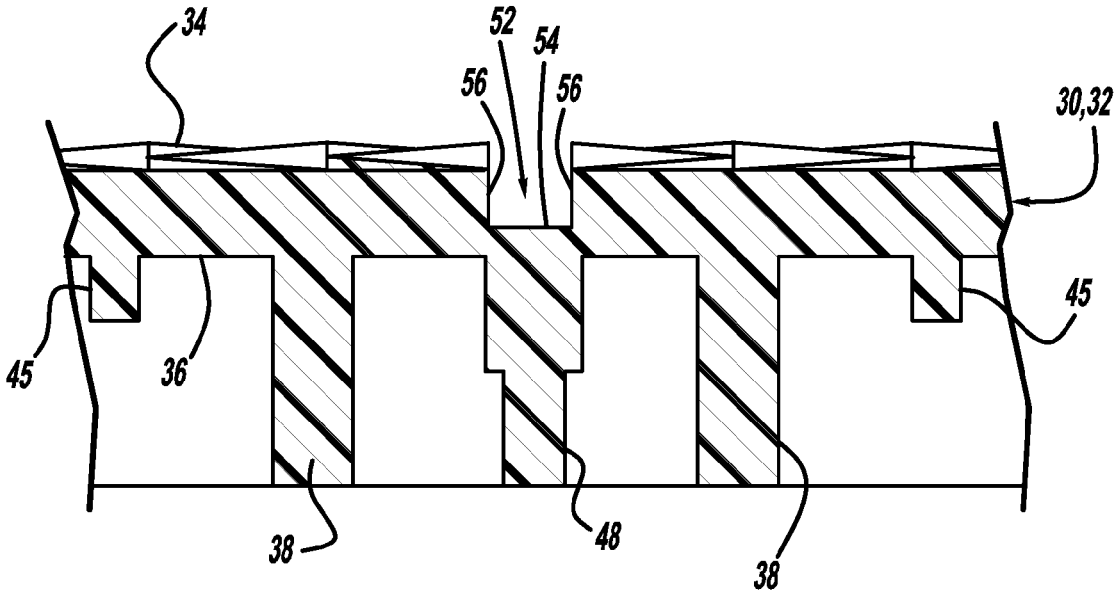
FIG. 3 is a side elevation sectional view of a section of the improved mat of FIG. 2.
Figure 6:
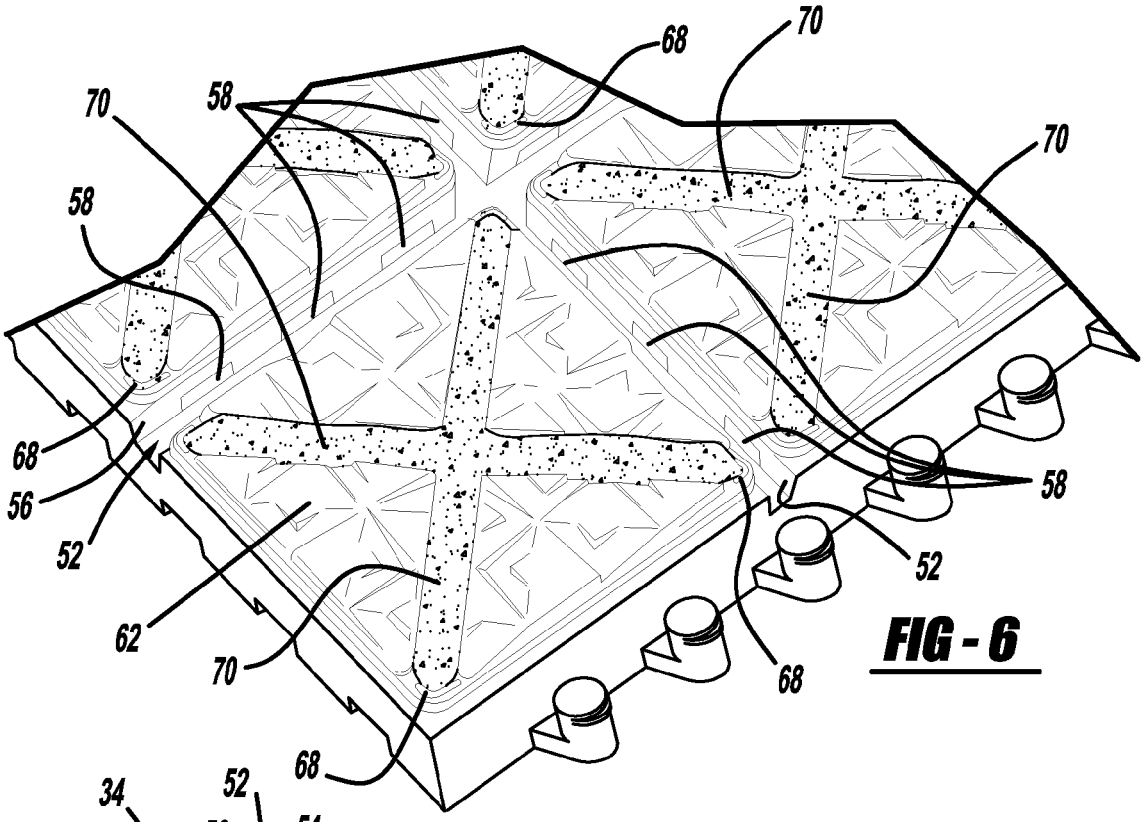

FIG. 6 is a perspective view of the mat segment of FIG. 1 after grit has been bonded into the grit trenches of the mat segment.

Figure 6A:
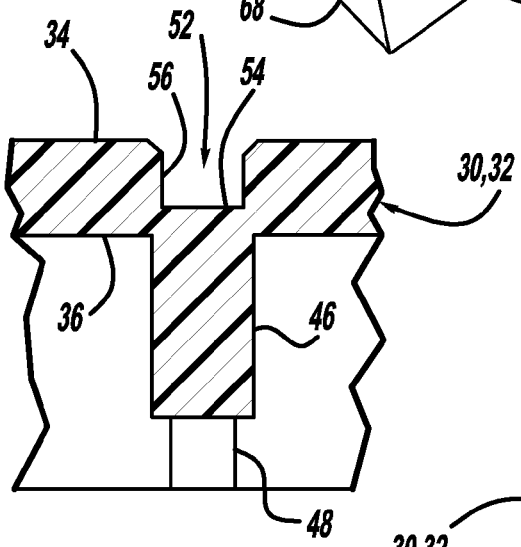
Figure 6B:
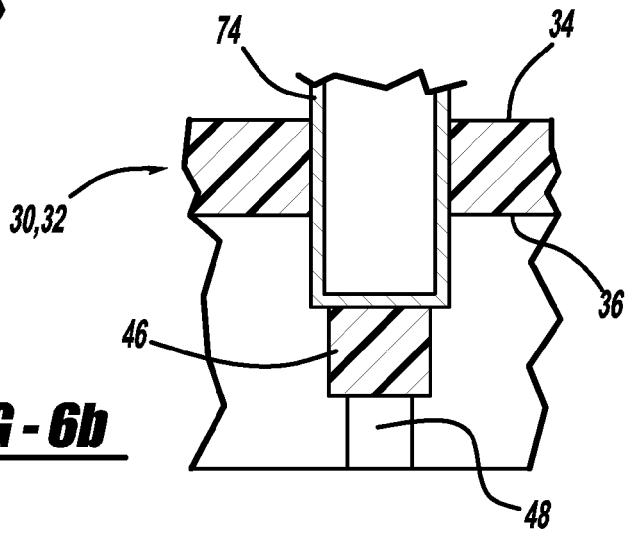
Figure 6C:
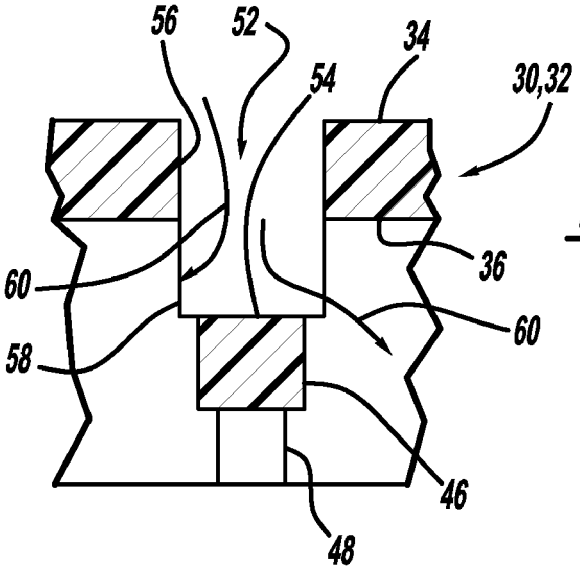

FIGS. 6*a*, 6*b* and 6*c* are sectional views of a channel of an improved mat showing the process for creating a drain opening within the lateral walls of the channel.

Figure 7:
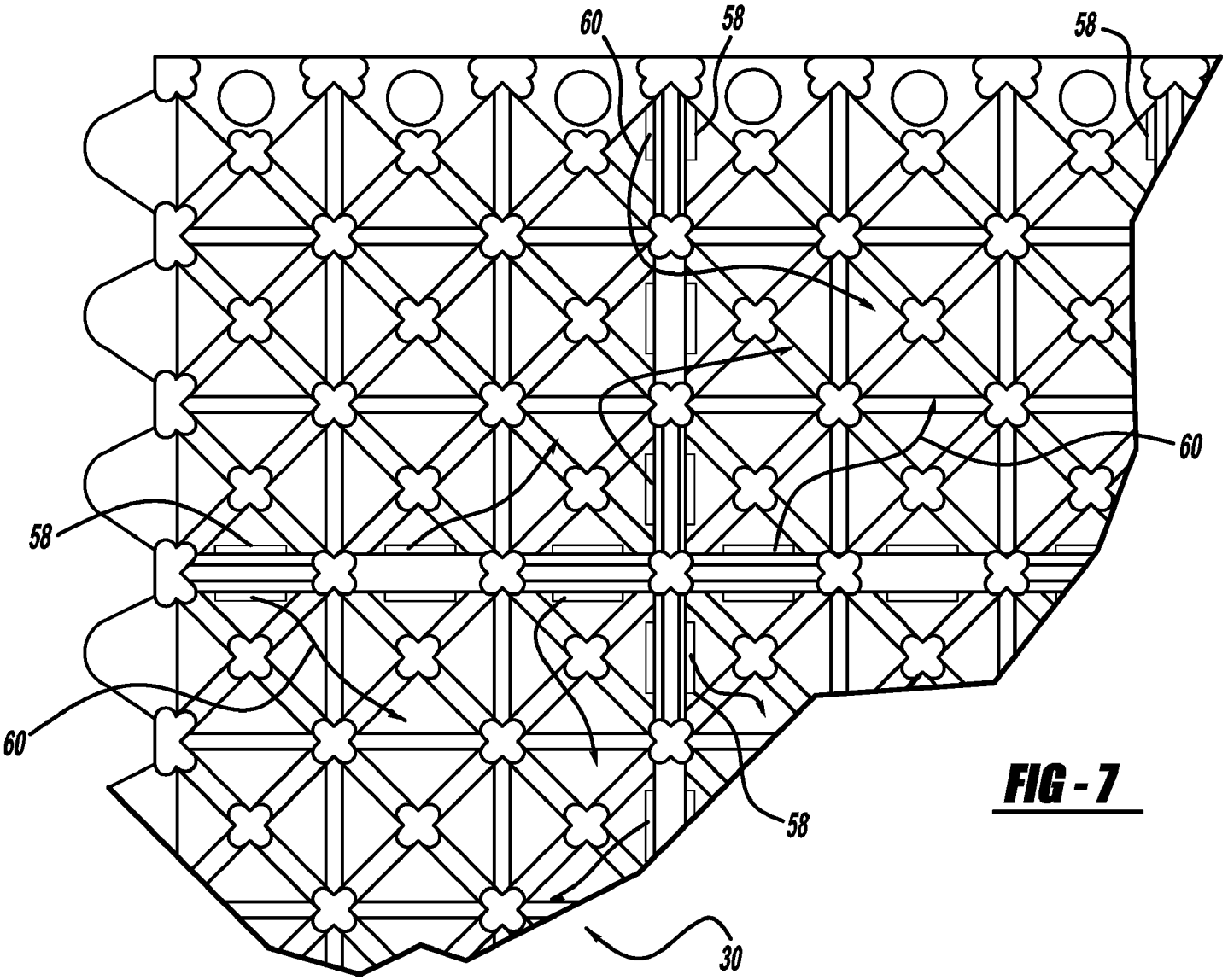

FIG. 7 is a bottom plan view of an improved mat showing drainage paths.

Figure 8:
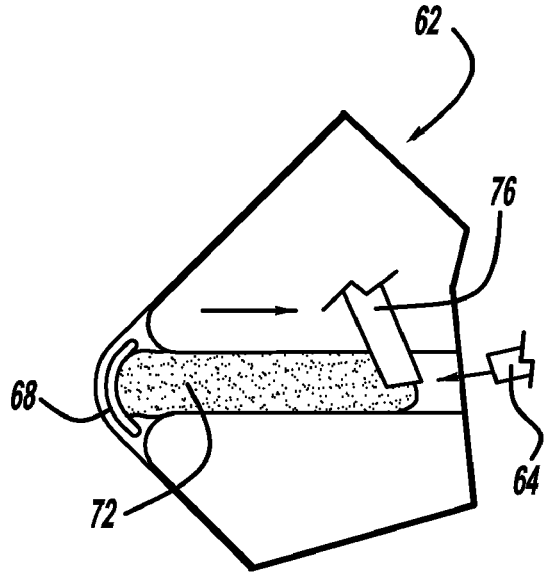

FIG. 8 is a top plan fragmentary view of the mat segment of FIG. 1 showing the application of adhesive to a grit trench.

Figure 9:
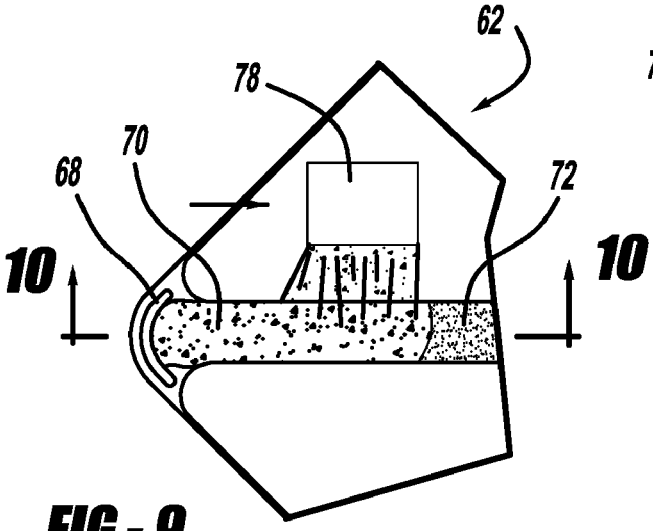

FIG. 9 is a top plan fragmentary view of the mat segment of FIG. 1 showing the application of grit to a grit trench.

Figure 10:
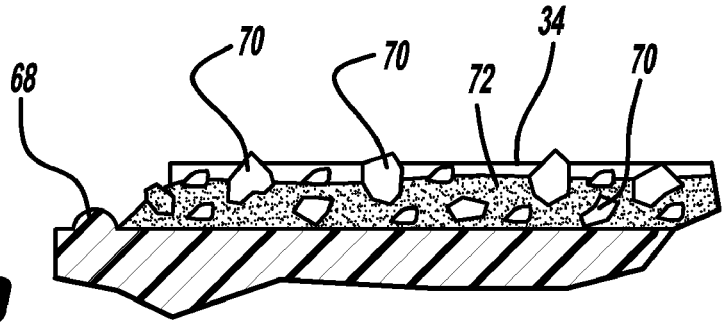

FIG. 10 is a side elevation sectional view of the mat segment of FIG. 9 showing grit bonded by an adhesive into the grit trench of the mat segment.

DESCRIPTION

The preferred embodiment of the improved mat 30 and methods for fabricating it are shown in FIGS. 1 through 10. Preferably, the mat 30 is molded from a hard rubber. This will promote durability. The mat 30 is comprised of a mat base 32, long legs 38, short legs 40, ribs 44, channels 52, grit trenches 64, adhesive 72 and grit 70. The mat base 32 has a top surface 34 and a bottom surface 36.

The long legs 38 are perpendicularly attached to the bottom surface 36 of the mat base 32. This will provide resilient support for the mat base 32. The short legs 40 are perpendicularly attached to the bottom surface of the mat base 32. The long legs 38 and the short legs 40 are adapted to provide a selected mat compression when a load is applied to the top surface 34 of the mat base 32. The combination of long legs 38 and short legs 40 causes the mat 30 which is constructed from hard rubber to feel and function as if it were constructed from a softer, more compressive rubber.

This function is shown in FIGS. 5*a*, 5*b* and 5*c*. There, a compressive force 42 is applied to the top surface 34 of the mat base 32. Before the compressive force 42 is applied the long leg 38 is in contact with the ground. The short legs 40 are raised above the ground. The compressive force 42 causes the long leg 38 to compress thereby bringing the short legs 40 closer to the ground. Finally, in FIG. 5*c*, the short legs 40 contact the ground and begin to compress. The result is a mat 30 constructed from hard rubber which compresses as if it were constructed from a softer material. We have found that when using a configuration similar to that depicted in FIG. 2 to fabricate an 18 inch by 18 inch by three-quarter inch mat, the combination of 504 long legs and 144 short legs 40 provides the preferred compression of the mat.

The molded mat 30 contains a number of different rib 44 styles. Shorts support ribs 45 are used to provide structural integrity, especially near the drain openings 58 described below. Long ribs 48 are used to connect legs 38, 40. Each long rib 48 is approximately the length of the legs 38, 40 to which it is to be attached. However, the long ribs 48 do not exceed the length of the legs 38, 40 to which they are attached. A plurality of long ribs 48 are each connected to a pair of legs 38, 40. The long ribs 48 will thereby prevent the mat 30 from sinking into and becoming embedded into a grating upon which it is placed. The mat 30, may also be used on top of a solid floor. If only long ribs 48 were used to connect the legs 38, 40, drainage from the top of the mat 30 to the exterior of the mat 30 and air circulation within the mat 30 may be inhibited. Therefore, a plurality of short ribs 46 are used, instead of long ribs 48, to interconnect some legs 38, 40. This will result in expanded gapping between the floor and the short ribs 46, thereby promoting drainage and circulation, as shown by the drain paths 60 in FIG. 7.

The channels subdivide the mat top surface 34 into mat segments 62, as shown in FIG. 1. Each channel 52 has a floor 54 and a lateral wall surface 56. Most channels 52 have two lateral wall surfaces 56. Preferably, the lateral wall surfaces 56 contain drain openings 58. Such drain openings 58 are positioned upon a vertical lateral wall surface 56 rather than horizontally oriented, as in current mats. Because the drain openings 58 are on vertically oriented surfaces the drain openings are less likely to become clogged by contaminants. The drain openings 58 are also much less likely to trap hard and dangerous objects resulting in safety hazards. Liquids and other contaminants drain through the drain openings 58 to the bottom of the mat 30 and to the exterior of the mat 30 by way of the drain paths 60.

The grit trenches 64 are embedded within the top surface 34 of the mat base 32. The grit trenches 64 are intended to hold grit 70. Each grit trench 64 has two ends 66. Each end 66 has a retention lip 68 forming a dam for retaining adhesive 72 and grit 70. The retention lip 68 prevents the adhesive 72 from flowing out of the grit trench 64, while the adhesive 72 is in a liquid form. This enhances the ability to selectively place grit 70 upon the top surface 34 of the mat 30.

Grit 70 is securely bonded into the grit trenches 64 with the adhesive 72. The preferred grit 70 is silicon carbide. The preferred adhesive 72 is cyanoacrylate. In order to minimize the likelihood of mat 30 flexure causing the grit 70 to become unbonded, the grit 70 and adhesive 72 are placed substantially below the top surface 34 of the mat 30, as shown in FIG. 10. However, some of the grit 70 must protrude above the top surface 34 of the mat base 32 in order for the grit 70 to increase the coefficient of friction of the top surface 34 of the mat base 32. To further reduce unbonding of grit 70 by flexure, long legs 38 are perpendicularly attached to the bottom surface 36 of the mat base 32 below the grit trenches 64 in order to provide support for the grit trenches 64. Because the grit 70 and adhesive 72 are substantially below the top surface 34 of the mat base 32 and because the grit trenches 64 are supported by long legs 38 grit 70 may be selectively placed upon the top surface 34 without significant unbonding being caused by flexure.

Lateral drain openings 58 positioned upon a lateral wall surface 56 are difficult to cost effectively fabricate by molding. Another technique is needed to fabricate the drain openings 58. First, a mat 30 is molded such that it has a top surface 34 and a bottom surface 36. It is molded such that channels 52 subdivide the mat top surface 34 into mat segments 62. As previously described, the channels 52 have a floor 54 and a lateral wall surface 56. The mat 30 is fabricated such that a rib 48 is perpendicularly molded into the bottom surface 34 of the mat 30 below each channel 52.

Drain openings 58 may be created within the lateral wall surfaces 56 of each channel 52 by removing material from the floor 54, at least one lateral wall surface 56 and the underlying rib 48, 46 of the channel. The material must be removed to a depth which is below the bottom surface 36 of the mat base 32 in order to form a drain opening 58.

The material may be removed with a grooving tool such as a tire groover. The grooving tool has a heated blade 74 for removing rubber. Preferably, the material is removed from the floor 54 of each channel 52 and its underlying rib 48, 46 by a process which uses a programmable Cartesian robot. The first step of the process is to attach a grooving tool having a heated blade 74 to the robot. Preferably, the grooving tool is a tire groover. The robot is programmed to remove the material from the floor 54 of each channel 56 and its underlying rib 46, 48. After the groover is attached to the robot and the robot is programmed, the mat 30 is secured onto the workbed of the robot. Then, the material is removed from the floor 54 of at least one channel 52, at least one of its lateral wall surfaces 56 and its underlying rib 46, 48 with the robot and the attached groover, thereby forming a drain opening 58.

The robot may also be used to automate the bonding of grit 70 into the trenches 64 embedded within the top surface 34 of a mat 30. First an adhesive dispenser 76 is attached to the robot. The robot is programmed to fill the trenches 64 with adhesive 72. The mat 30 is secured onto the workbed of the robot. The robot then fills the trenches 64 with adhesive 72. Before the adhesive 72 sets grit 70 is spread over it. Finally, the excess grit 70 is removed from the mat 30. Optionally, the programmable Cartesian robot may be equipped with a grit dispenser 78 for selectively spreading grit 70, as shown in FIG. 9.

Although the invention has been shown and described with reference to certain preferred embodiments, those skilled in the art undoubtedly will find alternative embodiments obvious after reading this disclosure. With this in mind, the following claims are intended to define the scope of protection to be afforded the inventor, and those claims shall be deemed to include equivalent constructions insofar as they do not depart from the spirit and scope of the present invention.

What is claimed is:

1. A mat comprising:

(a) a mat base having a top surface and a bottom surface; and (b) a plurality of channels subdividing the mat top surface into mat segments, wherein each said channel has a floor and a lateral wall surface, wherein at least one lateral wall surface has a drain opening positioned upon the lateral wall surface, rather than being horizontally oriented, permitting drainage from the top surface of the mat to below the bottom surface of the mat and wherein the top surface of the mat covers the drain opening.

2. The mat of claim 1, wherein the mat is fabricated from rubber.

* * * * *